US009580975B2

(12) United States Patent
Carlsen et al.

(10) Patent No.: US 9,580,975 B2
(45) Date of Patent: Feb. 28, 2017

(54) CYLINDER RELEASE ARRANGEMENT

(71) Applicant: FMC Kongsberg Subsea AS, Kongsberg (NO)

(72) Inventors: Hans-Paul Carlsen, Notodden (NO); Tor-Øystein Carlsen, Kongsberg (NO); Olav Inderberg, Kongsberg (NO); Anthony D. Muff, Kongsberg (NO); Arild Sundkvist, Kongsberg (NO); Pål Fadum, Kongsberg (NO); Roy Arne Klevstad, Kongsberg (NO); Thor-Arne Løvland, Oslo (NO); Simen Rønne, Kongsberg (NO); Geir Tandberg, Tranby (NO); Bernt Olav Tømmermo, Notodden (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 0 days.

(21) Appl. No.: 14/759,875

(22) PCT Filed: Jan. 7, 2014

(86) PCT No.: PCT/EP2014/050164
§ 371 (c)(1),
(2) Date: Jul. 8, 2015

(87) PCT Pub. No.: WO2014/108405
PCT Pub. Date: Jul. 17, 2014

(65) Prior Publication Data

US 2015/0354289 A1 Dec. 10, 2015

(30) Foreign Application Priority Data

Jan. 8, 2013 (NO) ..... 20130036

(51) Int. Cl.
*E21B 17/06* (2006.01)
*E21B 19/16* (2006.01)
(Continued)

(52) U.S. Cl.
CPC ..... *E21B 17/06* (2013.01); *E21B 17/01* (2013.01); *E21B 19/002* (2013.01);
(Continued)

(58) Field of Classification Search
CPC ..... E21B 17/06; E21B 19/002; E21B 19/004; E21B 17/01; E21B 19/16; Y10T 137/1774
(Continued)

(56) References Cited

U.S. PATENT DOCUMENTS 4,059,288 A 11/1977 Mohr
4,361,165 A 11/1982 Flory
(Continued)

FOREIGN PATENT DOCUMENTS

EP 2 310 613 B1 4/2011
WO WO 2009/153567 A1 12/2009

*Primary Examiner* — Matthew R Buck

(57) ABSTRACT

The invention relates a cylinder release arrangement, wherein at least one cylinder is arranged with a piston within the cylinder, and a cylinder head closing off one end of the cylinder, forming a chamber between the piston and the cylinder head, wherein the cylinder is provided to arrange a leakage of fluid from one side of a piston to the other side of the piston, when the piston is in a given position within the cylinder, and release means are provided for the subsequently controlled release of the cylinder head from the cylinder. The invention also comprises a cylinder arrangement with a release mechanism.

10 Claims, 5 Drawing Sheets

(51) Int. Cl.
*E21B 19/00* (2006.01)
*E21B 17/01* (2006.01)

(52) U.S. Cl.
CPC ..... *E21B 19/004* (2013.01); *E21B 19/16* (2013.01); *Y10T 137/1774* (2015.04)

(58) Field of Classification Search
USPC ..... 166/340
See application file for complete search history.

(56) References Cited

U.S. PATENT DOCUMENTS

| | | | | |
|---|---|---|---|---|
| 4,364,587 | A | 12/1982 | Samford | |
| 4,712,620 | A | 12/1987 | Lim et al. | |
| 4,880,257 | A * | 11/1989 | Holbert, Jr. | E21B 17/06 285/2 |
| 5,158,142 | A * | 10/1992 | Miszewski | E21B 17/06 166/237 |
| 6,354,379 | B2 * | 3/2002 | Miszewski | E21B 17/06 166/376 |
| 6,425,443 | B1 * | 7/2002 | Hill | E21B 17/06 166/242.6 |
| 6,530,430 | B2 | 3/2003 | Reynolds | |
| 8,181,704 | B2 | 5/2012 | Fenton | |
| 8,210,264 | B2 * | 7/2012 | Mohr | E21B 17/06 166/340 |
| 8,727,014 | B2 * | 5/2014 | Edwards | E21B 19/006 166/350 |
| 9,038,731 | B2 * | 5/2015 | Edwards | E21B 19/006 166/340 |
| 9,169,699 | B2 * | 10/2015 | Rytlewski | E21B 23/02 |
| 2011/0127041 | A1 | 6/2011 | Edwards et al. | |
| 2012/0031622 | A1 | 2/2012 | Carlsen et al. | |

* cited by examiner

CYLINDER RELEASE ARRANGEMENT

FIELD OF THE INVENTION

The invention relates to a cylinder release arrangement and a cylinder arrangement with a release mechanism.

BACKGROUND OF THE INVENTION

Risers are normally used to link hydrocarbon wells on the seabed to offshore floating structures. A riser is normally made up of lengths of steel tubing having significant diameter, making them heavy. The floating structure therefore needs to apply tension to the riser to prevent it from buckling and possibly collapsing under its own weight, and to prevent the weight from acting on the wellhead. This tension system is also compensated for movements of the platform relative the seabed, e.g. to keep a relative steady tension in the riser. Problems may occur when the platform experiences conditions out of normal operation range, such as drive-off and drift-off, or if the heave compensation system is not working properly. All these conditions may result in excessive tension in the riser, and at some point the riser will break. To address this problem, risers may be provided with a weak link which has a lower tensile rating than the other components of the riser such that a breakage will occur at a predetermined point and a predetermined tension in the riser.

A weak link should comply with the following requirements:

Protect barriers, both primary and secondary;

Protect personnel;

Protect the environment.

A conventional weak link comprises two parts which are releasable attached to one another by, for example, studs, which fracture at a predetermined tensile force. Such conventional weak link systems are able to withstand tensile forces applied to the weak link not only by the offshore structure, but also by well pressure. The studs therefore have to be rated to separate at a tension which is a combination of the separation force supplied by the well pressure and the tension applied from the surface. The well pressure fluctuates. At high well pressures a conventional weak link can provide a very limited operational utilization as it will require a very limited external tension before it breaks, and at low pressures a conventional weak link can fail to protect the system as it will require a relatively higher external tension before it breaks. This might be a problem, both with regards to the operational window, but also in relation to safe protection of existing equipment at the wellhead, such as the barrier within the well.

Another issue with standard weak links is that breaking a weak link in a riser due to excessive tension, e.g. as a result of drive-off, drift-off or a sudden rise in the fluid pressure within the riser, will release massive forces which will act on the riser and give the riser an undesired behaviour. If the riser breaks due to excessive tension, the riser will act like a pulled-out spring and may, in a worst case scenario, shoot out of the water like a projectile towards the offshore structure and cause severe damage to personnel and/or the structure/platform. Another problem may be that if the weak link and/or riser connection break, entrapped gas or hydrocarbons may be released to the sea or surface. In such situations it is desirable to be able to control the behaviour of the riser and the riser contents, and possibly perform a controlled disconnect. Different solutions have been used in the technical fields of weak links and pressure compensated riser connections, including those disclosed in European Patent No. EP 2310613 and U.S. Pat. Nos. 8,181,704, 5,382,052, 4,361,165 and 4,059,288.

An objective of the present invention is therefore to provide a cylinder release arrangement and/or a cylinder arrangement with a release mechanism which may be used in applications where it is desirable to disconnect a cylinder quickly and in a safe manner, possibly allowing for a larger operational envelope.

The cylinder release arrangement and/or a cylinder arrangement with a release mechanism in accordance with the invention may be used in a safety joint to limit the problems related to prior weak links and allow for a larger operational envelope compared to traditional weak links. The cylinder release arrangement and the cylinder arrangement with a release mechanism may also have other fields of use where it is necessary to safely and quickly release an internal pressure within a cylinder. This may include any cylinders used in connection with riser applications.

SUMMARY OF THE INVENTION

The invention relates to a cylinder release arrangement and a cylinder arrangement with a release mechanism which may be used in a safety joint, particularly a safety joint that gives the possibility of keeping a riser intact for a longer time period, and possibly keeps some tension in the riser if the heave compensation system is locked up, such that an operator has time to perform a safer standard release of the riser from the wellhead.

Compared to a traditional weak link designs, the safety joint fulfils the following objectives:

Extends available time to perform an ESD (Emergency Shut Down)/EQD;

Provides tension in the riser after activation of the safety joint;

Limits recoil due to hydrocarbon release;

Is independent of riser content;

Requires no cutting/closing of the bore;

Is independent of internal pressure;

Is environmentally friendly.

The safety joint comprises a first riser part and a second riser part forming inner and outer riser parts, respectively, which parts are respectively connected to an upper part and lower part of the riser when in use in a riser.

These first and second riser parts are initially locked to each other with a release unit providing release functionality for the two parts which will be described below. This release unit will in a locked state act to move the two riser parts as one unit.

The invention is set forth and characterized in the independent claims, while the dependent claims describe other characteristics of the invention.

As mentioned above, the cylinder release arrangement and/or the cylinder arrangement with a release mechanism in accordance with the invention may in one aspect, but this is not mandatory to the invention, be implemented in a safety joint.

The invention concerns a cylinder release arrangement wherein at least one cylinder is arranged with a piston within the cylinder and a cylinder head closing off one end of the cylinder, thereby forming a chamber between the piston and the cylinder head. The cylinder may be configured to provide a leakage of fluid from one side of the piston to the other side of the piston when the piston is in a given position within the cylinder. Furthermore, release means are provided for the subsequently controlled release of the cylinder head from the cylinder.

In one aspect of the cylinder release arrangement, the piston may be provided with a piston rod. In this aspect the movement of the piston includes movement of the piston rod. According to one aspect, the leakage across the piston occurs when the piston is caused to move away from its sealing position within the cylinder. This may occur as the piston is moved to a position which opens a bypass bore in the cylinder and or the piston. In another aspect of the cylinder release arrangement, the piston may be caused to move out of a sealed abutment with a sealing surface in the cylinder.

As an alternative arrangement for providing leakage over the piston, the cylinder may be provided with a varying inner diameter along its length, and the piston may be moved to a position where the size of the inner diameter of the cylinder exceeds the diameter of the piston, thus allowing a gap to occur between the piston and inner diameter so that leakage of fluid may occur from one side of the piston to the other.

In another aspect of the cylinder release arrangement, the release means may comprise a release part of the piston and fingers connected to the cylinder head which interact with the cylinder wall to lock the cylinder head within the cylinder. In this aspect, when moving the piston further away form the sealing surface, the release part may cause the fingers to move out of locking contact with the cylinder wall as they interact with the release part, thereby providing for the release of the cylinder head from the cylinder.

In another aspect of the cylinder release arrangement, the interaction between the fingers and the release part may allow for the piston, the piston rod and the cylinder head to move away from the sealing surface and release the cylinder head from the cylinder.

In another aspect of the cylinder release arrangement, the piston with the release part may be moved into interaction with the fingers, and as the release part is moved towards the fingers, a thickened portion of the piston rod, is moved out of locking contact with the fingers.

In another aspect of the cylinder release arrangement the fingers may be arranged to flex inwardly when interaction occurs between the release part and the fingers.

In another aspect of the cylinder release arrangement, the locking contact between the thickened portion of the piston rod may lock the fingers in contact with complementary holding ridges in the cylinder. The fingers may be formed with holding ridges as a part of their outer surface.

In another aspect of the cylinder release arrangement the deformation of tension rods connected between two riser parts may actuate the movement of the piston rod and thereby the piston. Extension of the tension rods may then move the piston such that the release means are activated and released.

The invention also includes a cylinder arrangement with a release mechanism. The cylinder arrangement comprises a cylinder, a piston positioned within the cylinder which is connectable to a piston rod, and a cylinder head closing off one end of the cylinder to thereby form a chamber between the piston and the cylinder head. The cylinder head comprises axial extending fingers provided with a radial inward flexibility, wherein the fingers are locked in locking engagement to the cylinder wall by a thickened portion of the piston rod. The piston rod further comprises a release part arranged at a distance from the thickened portion. The release part is configured for interaction with the fingers, such that when the piston moves to a finger release position and the piston rod is moved in axial direction relative to the cylinder, the thickened portion will move out of locking interaction with the fingers. Further movement of the piston rod brings the release part into contact with the fingers and causes the fingers to flex radially inward out of engagement with the cylinder to ensure release of the cylinder head from the cylinder.

In one aspect of the cylinder arrangement with a release mechanism, the thickened portion and release part of the piston rod are provided in a piston rod part separate from the piston or a piston rod attached to the piston and remain in position until the piston is moved to a position where it interacts with the separate piston rod part and moves this part relative to the cylinder, thereby releasing the cylinder head.

The safety joint comprises:

a first riser part and a second riser part overlapping in an axial direction and having end connections which are connectable to a riser, a release unit locking the two riser parts together in a not activated mode, the release unit having other modes comprising a partly activated mode and fully activated mode, where the release unit comprises at least one axial extending tension rod connected between the two riser parts, which tension rod is configured to deform plastically before breaking, thereby activating the partly and fully activated modes, and at least a cylinder arrangement which is arranged such that it compensates the at least one tension rod for internal pressure in the riser in the not activated mode and the partly activated mode and the safety joint in the fully activated mode.

The cylinder release arrangement and a cylinder arrangement with a release mechanism in accordance with the invention may be used for one or several cylinders in the safety joint, as mentioned above and described in more detail below. The cylinder arrangement may also be adapted for increasing the forces acting against release of the first and second riser parts in the fully activated mode.

The safety joint will normally be positioned in the lower half of the riser, in proximity of the wellhead. In such a position the safety joint will experience the larger forces from the surrounding water. The riser may be any kind of riser.

The safety joint will during normal operations not be activated, i.e. it will be in the not activated mode, but in cases of excessive tension in the riser, the safety joint will be activated by the excessive tension. Excessive tension will actuate the release unit in two intermediate steps until a potential complete disconnection occurs: a partly activated mode, a fully activated mode (whereupon there will be a telescopic action in the joint), and potentially ending in a complete disconnection where the two riser parts are completely separated. Both the initial and the intermediate steps of the release unit will be pressure compensated for pressure of the fluid within the riser. These steps will give time to operate a safe disconnection of the riser from the wellhead. If not, the safety joint may also be configured to release the two riser parts from each other as a complete disconnect.

According to an aspect of the invention, the cylinder arrangement may comprise one cylinder set arranged such that it compensates the at least one tension rod for internal pressure in the riser in the not activated mode and the partly activated mode and is adapted for increasing the forces acting against the release of the first and second riser parts in the fully activated mode. In another embodiment the cylinder arrangement may comprise several sets of cylinders for providing the different functionalities to the release unit, such as pressure compensation for internal pressure at different modes and providing forces acting against release.

One possible solution is that the cylinder arrangement may comprise a first set of cylinders and a second set of cylinders, where the first set of cylinders is adapted for compensating the at least one tension rod for the internal pressure in the riser in the not activated mode, and the second set of cylinders is adapted for compensating the at least one tension rod for the internal pressure in the riser in the partly activated mode, and wherein the second set of cylinders is adapted for increasing the forces acting against the release of the first and second riser parts in the fully activated mode.

The tension rods will have an axial length and be formed with a material enabling plastic deformation. This will allow them to deform a considerable length before breakage. The plastic deformation may be around 10% of the original axial length of the tension rods. The plastic deformation of these tension rods will give a movement of the two riser parts and a relative movement of the elements in the cylinder arrangement connected to the different riser parts. This movement will initiate different steps in the activation of the release unit.

According to an aspect, the tension rod(s) will be connected to the two different riser parts of the safety joint, as will at least a cylinder with piston and piston rod as part of the cylinder arrangement. The safety joint may be configured such that pressure of the fluid within the riser acts on one side of the piston in the cylinder(s) in the opposite direction of both the tension force in the riser and an end cap effect of the internal pressure of the fluid in the riser acting in the same direction as the tension force. This will pressure compensate the tension rod for the pressure of the fluid within the riser. The areas of the piston(s) in the cylinders are balanced in relation to the end cap effect of the riser to achieve the desired effect, i.e. the sum of the areas of the pistons equals the area of the end cap, resulting in that the internal pressure of the fluid within the riser is cancelled out. This system may be used in connection with a cylinder arrangement with one set of cylinders and an arrangement with first and second cylinder sets.

According to an aspect, where a release unit is arranged with the first and second cylinders, the first cylinder is arranged to pressure compensate the tension rods in a not-activated mode.

In the partly activated mode of the release unit, the tension rods will be extended as the tension in the material tension rods reaches the elasticity module of the material of the tension rods, thereby extending them in the axial direction permanently. This extension of the tension rods may result in that the pistons in the first set of cylinders move out of sealing contact with the respective cylinders, thereby enabling a leakage of the operating fluid (hydraulic fluid) around the side of the pistons. The piston(s) in the first set of cylinders will thereafter not act as pressure compensators for the tension rods, and this function has to be moved to the second set of cylinders, as will be described below.

To achieve this desired leakage in the first cylinder set, one possible solution is to form the cylinder with different inner diameters along the length of the cylinder. Another possibility is to form a bore in the cylinder which is sealed by the piston in a first position but open when the piston is in another position. It is also possible to have leakage across the piston.

As the first set of cylinders no longer pressure compensates the tension rods, one does not want them to influence the safety joint unnecessary and one may therefore, when the safety joint extends further, release the cylinder heads of the cylinders in the first set of cylinders so as to minimize the risk of double compensation and influence of the first cylinder set. This release of the cylinder heads may be done in several manners, such as breaking the cylinder head if it is made of glass. Another possibility is to have the piston interact with the cylinder head and release the locking of the cylinder head in the cylinder. By releasing the cylinder heads, the first set of cylinders is exposed to the surrounding seawater. That is, if the fluid above the pistons in the cylinders in the first set of cylinders is bled off before the cylinder head is released, there is no pressure in the fluid acting on the cylinder head, thereby enabling a more controlled release of the cylinder head. It is important not to have a double pressure compensation of the tension rods as this may result in loss of control of the riser because the double compensation may over-compensate or under-compensate the riser.

In the partly activated mode of the release unit, the tension rods are still pressure compensated. In the embodiment referred to above, the second set of cylinders is adapted for compensating for the internal pressure in the riser in the partly and fully activated modes, which will be explained in more detail below.

Before a first step of the actuation of the release unit, also referred to as the not activated mode, the piston arranged in the second set of cylinders may be free floating in relation to the piston rod. The pistons may possibly be arranged near one end of the cylinders. The second cylinders will in this state not experience any of the pressure within the riser and they will not influence the tension rods. The second set of cylinders will therefore not influence the safety joint until the safety joint is in the partly activated mode.

When the first step, the partly activated mode, of the release unit is activated, the tension rods are extended axially. This will move the piston rod relative the pistons in the second set of set of cylinders. This axial movement will lead to an interaction between the piston rod and piston and they will be linked to each other. In addition, the first part of the riser will move relative the second part of the riser and thereby open an opening such that the pressure within the riser acts on the piston in the second set of cylinders. The safety joint is then configured such that the pressure on the pistons in the second set of cylinders will act on the safety joint and thereby the tension rods and pressure compensate it in relation to the internal pressure in the riser. The opening transferring the pressure of the riser fluid to the second set of cylinders may be a fully open opening, or alternatively, there may be arranged restrictions in this opening, such as pressure operated valves or other elements. The configuration of the safety joint may also be such that one may substitute these elements in the opening during maintenance of the safety joint, giving the safety joint modular properties.

One possible solution for providing this open access between the internal pressure of the riser and the second cylinder is to provide a sealing between the inner and outer riser parts. The sealing will be active when the first and second riser parts are in a fully collapsed state. When the first and second riser parts axially move, as the tension rods are extended, the seal will no longer be active and the internal pressure of the fluid inside the riser will move out into the annular space between the inner and outer parts of the riser and into the second set of cylinders and act on one side of the pistons in the cylinder, i.e. the side which provides a force in an opposite direction compared to the end cap effect of the riser. A hydraulic fluid may initially be provided in this annular space. This solution also keeps the dirty fluid within the riser away from the cylinders and the compensation system until the first step (the partly activated mode) is initiated and partly until the second step (fully activated mode) of the release unit is activated. Another possibility is to have a burst disk which ruptures with axial displacement of the two riser parts. There is also the possibility of providing the second set of cylinders with a system similar to what will be described in greater detail later, where the riser fluid will act on a membrane/bellow separating dirty and clean fluids, and/or the possibility to integrate a system allowing possible partial degradation.

In the fully activated mode of the release unit, the tension in the riser has exceeded another threshold value of the tension rod(s) such that the tension rods will break. In this fully activated mode, when the tension rods are broken, the cylinder arrangement is configured to provide a force acting against the extension of the safety joint. The cylinder arrangement is also configured such that it allows a telescopic action between the two overlapping riser parts in the safety joint and pressure compensates the safety joint for internal pressure within the riser. The force created by the release unit will try to push the two parts towards each other, towards a collapsed state of the telescoping parts, thereby providing tension in the riser. This force will act against the separation forces. In one embodiment as referred to above with first and second cylinder sets, the second set of cylinders in part generates this force.

As the riser parts move away from each other in the fully activated mode, the piston in the second set of cylinders will move away from a position close to an end position within the cylinder. As this space is closed and is filled with a fluid at low pressure, this movement will create a 'vacuum effect' in the fluid. This 'vacuum effect' will try to pull the piston back into the cylinder. In addition, there will also be seawater pressing/pushing the piston rod into the cylinder. The sum of the seawater pressure on the piston rod end (the force resulting from a hydraulic column of seawater on the piston rod end) and the 'vacuum effect' in the cylinder will create a force pulling the upper and lower parts of the riser to a collapsed state, or in other words, acting against the separation force.

An alternative to the fluid with low pressure is to equip the pistons in the second set of cylinders with tension elements pulling the piston(s) back into the cylinder. This may be done in addition to the arrangement creating the 'vacuum effect'. Another possibility is to use a magnetic field, electric motor or other techniques to create a force.

In another aspect the cylinder arrangement may also comprise a third set of cylinders. The third set of cylinders may be activated during the fully activated mode of the release unit. This third set of cylinders is provided with seawater on one side of the piston and a fluid at low pressure on the other side of the piston. When the safety joint is extending, the pressure from the seawater acting on one side of the piston and a "vacuum effect" on the other side of the piston will both assist in pushing or pulling the two riser parts to a collapsed state, respectively. That is, the third cylinders provide a force that acts against the separation forces in the safety joint. This third set of cylinders is not in fluid connection with the internal fluid in the riser.

According to an aspect, the third set of cylinders may also be used alone, i.e. without the use of either the first or second set of cylinders, or used in combination with the first and or second set of cylinders, or used in combination with only the second set of cylinders, and without the rest of the release unit as such. One thereby has a riser joint with first and second riser parts which is arranged overlapping and which allows telescopic movement between them, where a cylinder housing is connected to one riser part and a piston rod with piston connected to the other riser part. The space enclosed by the piston in sealing contact with the cylinder housing is filled with a fluid at relatively low pressure, and the opposite side of the piston is exposed to the pressure of the surroundings, i.e. seawater when in use. The joint may also be provided with a second set of cylinders and pistons, where one side of the piston is exposed to the fluid pressure within the riser and the opposite side of the piston experiences a fluid at relatively low pressure. The space with low pressure creates a "vacuum effect" as the piston is moved out of the cylinder housing, pulling the piston back in the housing, and the seawater pressure creates a force pressing the piston into the cylinder housing, both acting against separation forces in the joint, while the joint is pressure compensated for internal pressure within the riser.

The piston rods, and thereby the pistons, are then connected with the first part of the riser and the cylinders are connected with the second part of the riser, or alternatively they may be arranged in opposite fashion. They will then during normal use form an upper and lower part of the safety joint, respectively, which may of course be changed without departing from the scope of the invention.

The first and second parts of the riser, and the cylinder and piston rod of the second set of cylinders and possibly the third set of cylinders, may have a length allowing telescopic motion between the riser parts without releasing the parts fully from each other. By allowing this movement, and also by providing some tension in the riser due to the forces trying to pull the two riser parts together to a collapsed state, it is possible to initiate the release of the riser in a safe manner from the wellhead in this fully activated mode without breaking off the riser as in a standard weak link. By configuring the cylinder arrangement to provide a force acting against the separation forces in a fully activated mode, one creates some tension in the riser due to the telescopic motion. This will give the possibility to lift off the EDP (Emergency Disconnect Package) from the LRP (Lower Riser Package) if the safety joint is positioned in an open sea mode, or possibly to disconnect the subsea test tree latch in the landing string. During this controlled disconnection from the EDP or LRP, the telescoping connection in the safety joint between the first and second riser parts will be forced to a collapsed state, minimizing the risk of an uncontrollable riser damaging the subsea equipment such as the EDP and the LRP.

According to an aspect, the first set of cylinders may have a smaller internal volume than the second set of cylinders. The difference in volume may possibly result in different stroke lengths in the first set of cylinders compared with the second set of cylinders. The first set of cylinders may in one embodiment have a shorter length than the second set of cylinders. The difference in volume may in addition to the difference in stroke length give a solution where the cylinder set with less volume gives a more responsive movement of the piston, i.e. more rapid response to the pressure variations in the riser. Even if an incompressible liquid is being used in the cylinders, the liquid will be somewhat compressible if the liquid volume is large. A smaller volume will therefore be favourable in the pressure compensation of the tension rods before they break or before they start to deform plastically, that is, in the partly and not activated mode of the release unit. However, it is desirable to have a large length of the piston rod in the cylinders in the fully activated mode, as the maximum telescopic motion of the safety joint will be limited by the stroke length of the piston in the cylinder.

According to another aspect the first set of cylinders may be connected to the second set of cylinders through a mechanical link, where the cylinders are arranged beside each other. The mechanical link may provide coordinated and linked movement of the pistons in the first and second sets of cylinders in the not activated mode and possibly the partly activated mode. The first and second sets of cylinders may also be arranged as an extension of each other. The first and second sets of cylinders may be provided one on top of the other along the riser parts. They may be arranged as separate cylinders or they may form a common cylinder with two pistons, one of which is initially floating. The first and second sets of cylinders may have a common piston rod or separate piston rods. The first and second cylinders may also have a common cylinder housing, or any combination of these arrangements.

The different sets of cylinders may comprise one cylinder or several cylinders. One set may comprise one cylinder and the other sets may comprise two, three, four, six, eight or more cylinders. The different sets of cylinders may also have equal or different numbers of cylinders. Alternatively, the cylinder arrangement may be an annular cylinder arrangement or a combination of one or several annular cylinder/piston sets and none, one or several annular cylinder/piston sets. However, the cylinder arrangement should be balanced around the circumference of the safety joint.

The first, second and possibly third sets of cylinders may be arranged around the circumference of the safety joint and on the radial outside of the first and second riser parts. They could be evenly spaced around the circumference and also evenly spaced in groups. The axially extending tension rods could be arranged in between the different cylinders. The tension rods may be positioned in between the first set of cylinders and have a length similar to the length of the first cylinder. Another possibly is to position the tension rods in between the second cylinders. The second and third sets of cylinders may be positioned in between each other around the same circumference, with the first set of cylinders arranged axially above or below the second and/or third sets of cylinders. The tension rods could be evenly spaced around the circumference or evenly spaced in groups around the circumference.

The riser parts will form part of the internal bore of the riser in a riser extending from the wellhead and up to a floating vessel. The second set of cylinders may have a stroke length similar to the length of the overlap between the first and second parts of the riser. The possible third set of cylinders may have a similar length.

A manifold system may be provided which is adapted for distributing fluid from a fluid pressure source to at least two cylinders in the cylinder arrangement. A possible embodiment of the manifold allows for partial degradation without losing functionality of the overall safety joint system. That is, if one of the cylinders in the cylinder arrangements fails or is destructed, or if a locking or leakage occurs in one of the cylinders, the manifold system is provided so that the remaining cylinders in the cylinder arrangement will not be effected. The manifold system comprises a manifold and a transfer line to distribute fluid pressure to the cylinders from a space, possibly annular, forming part of the manifold to at least two separate bores, each extending to at least two different cylinders, for instance in the same set of cylinders. In each bore a floating piston is arranged between the space in the manifold and the cylinder(s).

There may be one cylinder connected to each of these bores with a floating piston, or there may be groups of cylinders connected to each of these bores with a floating piston, or a combination of these.

The floating piston has at least one end position in the bore where it will seal off the bore between the space and the cylinder. There is also the possibility of having end positions for both ends of the floating piston. In a case with leakage in one of the cylinders, the floating piston for this cylinder will be pushed to its end position and thereby seal off this bore while the rest of the cylinders will still be active.

The fluid of the fluid pressure source may be different from the fluid within the cylinders and/or in the manifold and transfer line, in which case the pressure of the fluid from the fluid pressure source may be transferred to another fluid within the cylinder and/or in the manifold and transfer line. The two different fluids may then be separated by a membrane, and the pressure of the fluid from the fluid pressure source may be transferred through the membrane to the fluid of the cylinder and/or in the manifold and transfer line. Alternatively, the fluid from the fluid pressure source may be transferred directly into the cylinders.

The fluid pressure source for the distributing fluid within the manifold or transfer lines may be the internal pressure within the riser or a separate fluid pressure source.

If the fluid pressure source is the internal pressure within the riser, the rest of the cylinders will still be active and pressure compensate the tension rod, even if leakage occurs in one of the cylinders. With an end position in the opposite direction of the floating piston, one may prevent a clean fluid within the manifold and/or transfer bore from pushing a membrane into the riser bore.

There may also be a pressure compensating system without the partial degradation functionality where the space leads to one bore with a floating piston, which bore after the floating piston forms a manifold leading to the several pistons. The floating piston will seal off the one bore when it comes to an end position in the bore, but thereby also seal off the pressure transfer between the fluid pressure source, the internal pressure within the riser or separate fluid pressure source, and the cylinders. Both these possibilities may be considered a two barrier system, or one may also provide the floating piston with a two barrier configuration, such as two pistons in series or two sealing surfaces on the one piston.

The manifold may comprise at least one flow regulating means, which flow regulating means is adapted for regulating to which of the cylinders the fluid is distributed. The flow regulating means may also regulate the flow rate in one or both directions. There may be one manifold for the first set of cylinders. There may be one manifold for the second set of cylinders.

The safety joint may also be provided with an override system to be used in situations where large external forces on the system are expected, i.e. to provide a system that increases the connection force between the first and second riser parts and to make sure that the tension rods are kept undamaged. The override system may also be used for a weak link.

A situation where large external forces on the system are expected is for instance when the riser joint is lifted through the splash zone. This might be done by providing a separate cylinder/piston arrangement connected between the first and second parts of the riser. If the override system is applied to the safety joint, the cylinder/piston arrangement may use all or some of the cylinders in the first set of cylinders for this function, or position these specific cylinders in between the cylinders in the first set of cylinders. The cylinder providing the override system is fluid filled and locked in a set position. In one embodiment of the override system, the piston(s) is locked in a lower position in the cylinder(s) and the volume above the piston is fluid filled. The fluid may be locked in the cylinders by means of a valve which may be remotely operated. The locked fluid within the cylinders may be released to an active receiver with for instance 1 bar pressure or to the sea. Alternatively, one may add an additional pressure to the fluid in the cylinder by a connection to a pressure cylinder with for instance ~700 bar pressure. This override system may comprise a set of cylinders, including one cylinder, but preferably two or more separate cylinders, so as to provide redundancy in the system. In another embodiment the first set of cylinders may be provided with an opening allowing seawater pressure to act on the opposite side of the piston compared to the pressure from within the riser.

According to another aspect, an ROV (Remotely Operated Vehicle) may visually see if a 'gap' has been formed in the safety joint, which indicates that the partly activated mode has been initiated and that the riser should be safely disconnected from the wellhead and taken topside for maintenance and installation of new tension rod(s). The safety joint may therefore be reset back to its original state. One may also provide a monitoring of the gap, e.g. to give a signal to the operator if this first step (partly activated mode) of the release unit has been activated. This signal may be transferred to the operator remotely or in any other appropriate way.

In an aspect it is possible to arrange the second set of cylinders to compensate the tension rods for internal pressure during the whole operation, in the non-activated, partly activated and fully activated modes, making the first set of cylinders unnecessary. There may in this embodiment also be third cylinders, but it is possible to think of a solution without these.

According to other aspects the safety joint may in addition be equipped with a glass element and a breaking system which will, if the safety joint is extended to a predetermined length, initiate the breaking of the glass element and thereby release the two riser parts at the safety joint. There may also be a glass element in the form of a burst disc which is adapted to rupture at predetermined pressure differences. The burst disc allows for pressure communication between different cylinders in the cylinder arrangement, between the cylinder arrangement and the interior of the riser, and/or between the cylinder arrangement and the seawater.

There is also provided a solution for keeping clean fluid in the hydraulic system in the partly activated mode and only releasing clean fluid to the surroundings. The released clean fluid from this first set of cylinders will be a relatively small amount of clean fluid.

There may be alternative solutions for activating the partly activated mode and fully activated mode. These solutions may be electrically controlled, systems with springs, deformation controlled systems, brake pads on a rod, etc.

A method is suggested for operating a safety joint in case of excessive tension in a riser by providing a riser with a safety joint comprising a first riser part and a second riser part overlapping in an axial direction and connecting the ends to make the joint form part of a riser, the safety joint further comprising a release unit with at least one axial extending tension rod connected between the two riser parts, wherein the method comprises the steps of:

in a not activated mode, keeping the riser parts as one unit and pressure compensates the tension rods for internal pressure within the riser, increasing the tension in the riser to a partly activated mode, thereby creating plastic deformation of the tension rods, further increasing the tension in the riser to a fully activated mode, thereby breaking the tension rods, and in all modes, not activated, partly activated and fully activated, allowing controlled disconnection of the riser at another joint in the riser, or in a fully released mode, when tension is further increased, releasing the two riser parts of the safety joint.

The method may in one embodiment, after the step of increasing the tension in the riser to a fully activated mode, thereby breaking the tension rods, further comprise a step of activating a set of cylinders in a cylinder arrangement to create a force in the safety joint acting against the release of the two riser parts, and allowing telescopic action in the safety joint.

BRIEF DESCRIPTION OF THE DRAWINGS

These and other characteristics of the invention will be clear from the following description of an embodiment, given as a non-restrictive example, with reference to the attached drawings, wherein.

DETAILED DESCRIPTION OF THE INVENTION

Figure 1:
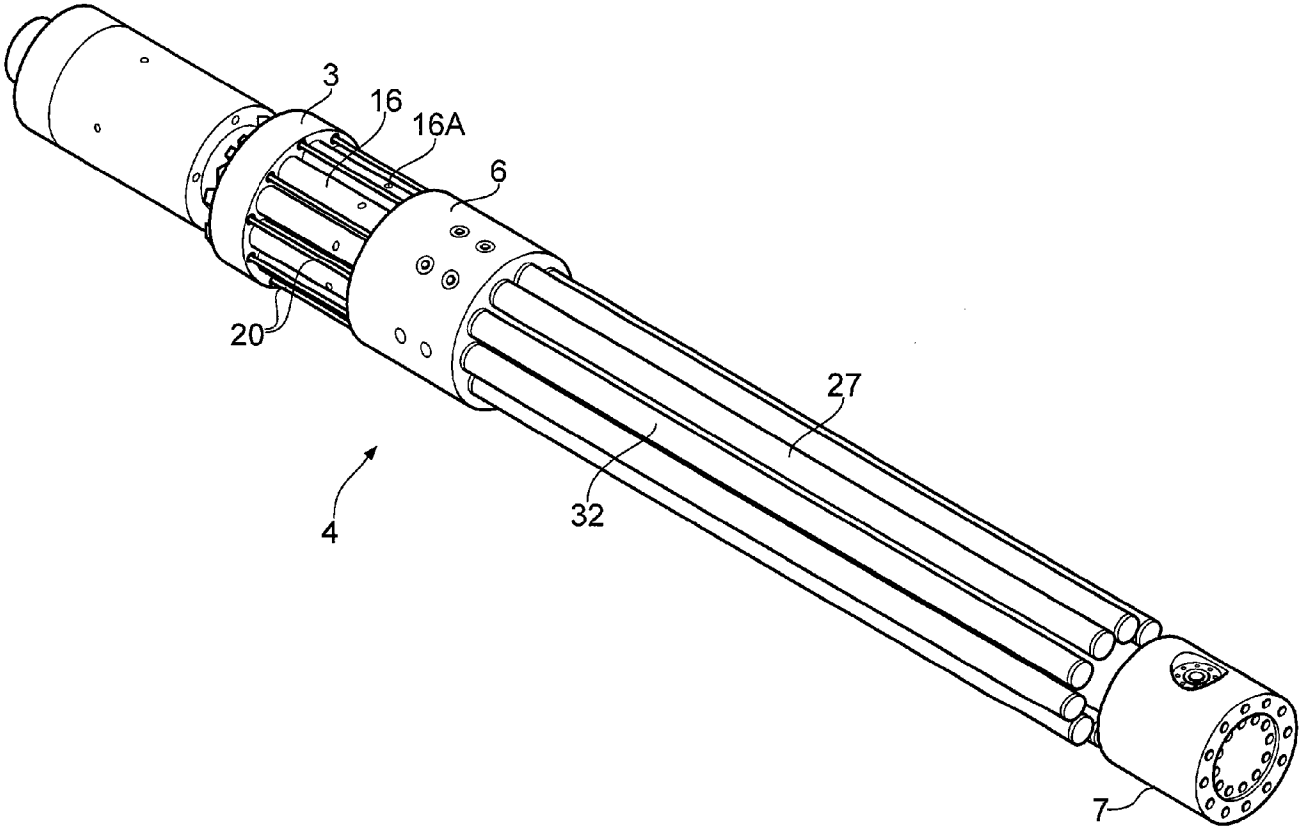
FIG. 1 is a perspective view of a safety joint in accordance with an embodiment of the invention.
Figure 2:
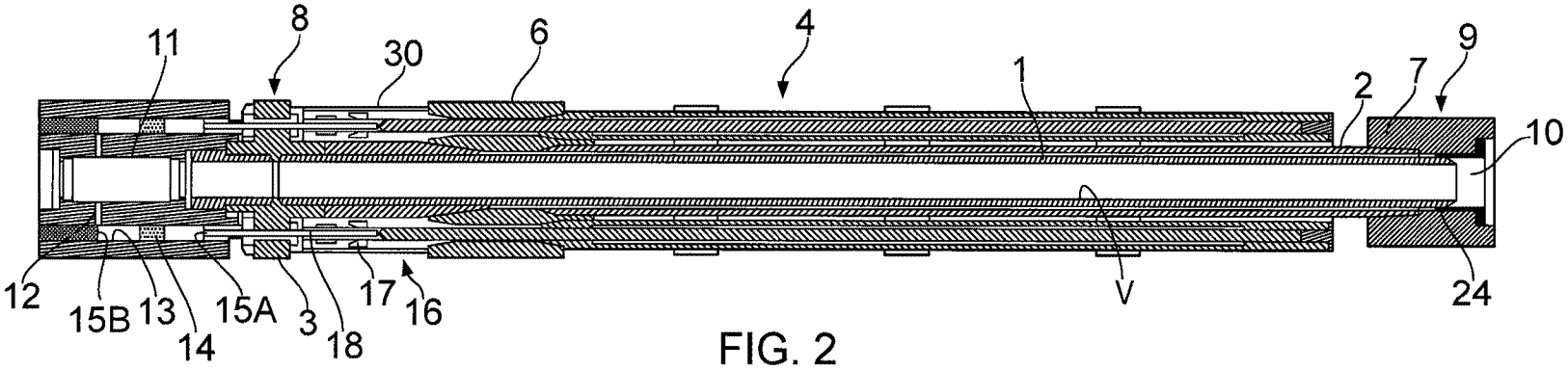
FIG. 2 is a cross section view of the safety joint of FIG. 1 shown in a collapsed state.

FIGS. 1 and 2 show an embodiment of a safety joint 4 of the present invention. The safety joint 4 is adapted to comprise part of a riser extending from a floating platform to a wellhead or similar subsea structure.

The safety joint 4 comprises a release unit for locking two riser parts 8, 9 together in a not activated mode. The release unit also has a partly activated mode and a fully activated mode, as will be explained below.

The release unit of the safety joint 4 comprises at least one axial extending tension rod 20 connected between the two riser parts 8, 9, which tension rod 20 is configured to deform plastically before breaking, thereby activating the partly and fully activated modes. The at least one tension rod 20 is axially arranged along the longitudinal direction of the safety joint 4. The tension rod(s) 20 is connected to a first connection piece 3 at its the upper end and a manifold, which is shown in the figures as a manifold block 6, at its lower end. In between the tension rods 20 there is arranged a first set of cylinders 16. The first set of cylinders 16 may comprise one or a plurality of cylinders 30. The first set of cylinders 16 may have perforations 16A to the sea. A second set of cylinders 27, which set may comprise one or a plurality of cylinders 35, is arranged below the first set of cylinders 16. The cylinders of the second set of cylinders 27 are connected to the manifold block 6, which manifold block 6, through an outer barrel 2, is connected to a second connection piece 7. The manifold block 6 and the connection piece 7 are arranged at a fixed distance, while an inner pipe 1 and the cylinder rod of the second set of cylinders 27 may telescope. The cylinder rods of the cylinders of the first set of cylinders 16 are connected to the cylinder rods of the cylinders of the second set of cylinders 27. In an alternative embodiment the positioning of the first set of cylinders 16 and the second set of cylinders 27 may be switched, whereby the connections between the different parts may be similar to the described embodiment. In between the second set of cylinders 27 there may be arranged a third set of cylinders 32, which third set of cylinders 32 may comprise one or a plurality of cylinders. In the shown embodiment the third set of cylinders 32 is equal in length to the second set of cylinders 27. The different sets of cylinders 16, 27, 32 will be described in more detail below.

FIG. 2 shows a cross-sectional view of the safety joint 4 in the not activated mode (collapsed state), which mode is the normal operation mode for the safety joint 4. An inner bore 10 is formed in the safety joint 4 and extends through the whole length of the safety joint 4 as an extension of the bore 10 of the riser to thereby form a continuous passage between a well and the surface. The safety joint 4 comprises a first riser part 8 and a second riser part 9 arranged in a telescopic connection. The first riser part 8, i.e. possibly the upper part of the safety joint 4, is arranged in an overlapping manner in relation to the second riser part 9. The first riser part 8 has an inner barrel 1 movably arranged inside the outer barrel 2 of the second riser part 9, forming a volume V between the inner 1 and outer 2 barrels. In the not activated mode shown in FIG. 2, a sealing system 24 seals between the inner barrel 1 and the outer barrel 2 in the lowermost part of the inner barrel 1. The inner barrel 1 is connected to the first riser part 8 via the first connecting piece 3. The outer barrel 2 is connected to the second riser part via the second connection piece 7. It is possible to arrange these elements in the opposite manner.

Figure 5:
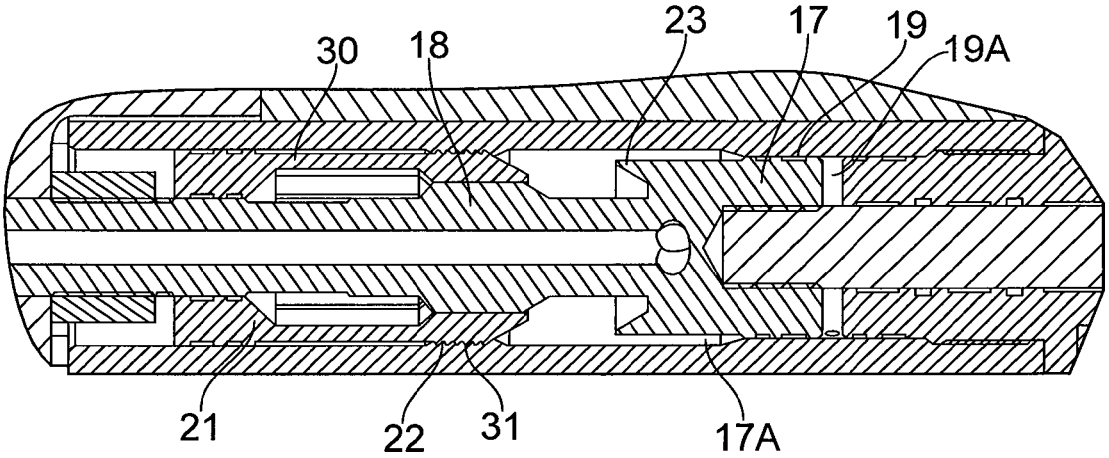
FIG. 5 is a detailed cross section view of the connection between the first set of cylinders and the second set of cylinders in the safety joint of FIG. 1.

One or a plurality of first radial bores 12 are arranged to fluidly connect the inner bore 10 with one or a plurality of axial bores 13 arranged on the radial outside of the inner bore 10. Furthermore, each axial bore 13 is connected to a cylinder of the first set of cylinders 16. A fluid-tight floating piston 14 floats inside each axial bore 13, which floating piston 14 can move between a first stopping surface 15A and a second stopping surface 15B in the axial bore 13. The floating piston 14 moves in the axial bore 13 as a response to pressure differences between the first and second sides (herein after referred to as the upper and lower sides) of the floating piston 14. Which side is the upper or lower side may be changed depending on the configuration of the safety joint. The pressure from the inner bore 10 acts on the upper part of the floating piston 14, while the pressure of each cylinder in the first set of cylinders 16 acts on the lower part of the floating piston 14. In the not activated mode, the first set of cylinders 16 will pressure compensate the safety joint 4, as the total downwardly working area 17A (best shown in FIG. 5) of the piston(s) 17 in the first set of cylinders 16 is similar to the upwardly working end cap area in the bore 10 of the riser in order to compensate the internal pressure in the inner bore 10, as the sum of the areas 17A of the pistons 17 equals the area of the end cap.

A number of axial tension rod(s) (not shown in FIG. 2, element 20 in FIG. 1) may be arranged in between the first set of cylinders 16. The tension rods 20 may deform axially plastically (up to ~10% their original length), before they break. These tension rods 20 may have a length of 0.5 meters to 2 meters, possibly 1 meter, depending on the material in the tension rods and the configuration of the safety joint 4. The extension of the tension rod will initiate the different modes of the safety joint. The operator can choose the strength of the tension rods based on the demands of different projects. During normal operating conditions, i.e. when the safety joint 4 is in the not activated mode, the tension rod(s) are intact, are not exposed to any excessive forces and are pressure compensated in relation to internal pressure within the riser.

On the inside of the inner bore 10, covering the first radial bores 12, is arranged a bellow 11 allowing pressure communication between the inner bore 10 and the axial bores 13. The bellow 11 separates the riser fluid from a clean hydraulic fluid in the axial bore 13. Each of the axial bore(s) 13 is fluidly connected to one cylinder of the first set of cylinders 16, such that the clean hydraulic fluid in the axial bore(s) 13 is the same hydraulic fluid as in the first set of cylinders 16. Thus, a downward movement of the floating piston 14 in the axial bore (as a response to a pressure increase of the fluid inside the riser) will result in a pressure increase in the clean hydraulic fluid, which pressure will act on the downwardly working area 17A of each cylinder/piston 17. Alternatively, one may omit the bellow 11, in which case the floating piston 14 will act as the dividing unit between the riser fluid and the clean hydraulic fluid.

If the safety joint 4, i.e. the tension rods 20, experiences excessive tension forces as a result of, e.g., excessive tension in the riser, the tension rods 20 will start to deform plastically in the axial direction and will result in relative movement between the first connecting piece 3 and the manifold block 6. This situation, i.e. the situation where the tension rods 20 have begun to plastically deform, is referred to as the partly activated mode. The plastic deformation of the tension rod(s) 20 will cause numerous actions in the safety joint 4, which are shown in FIG. 3.

Figure 3:
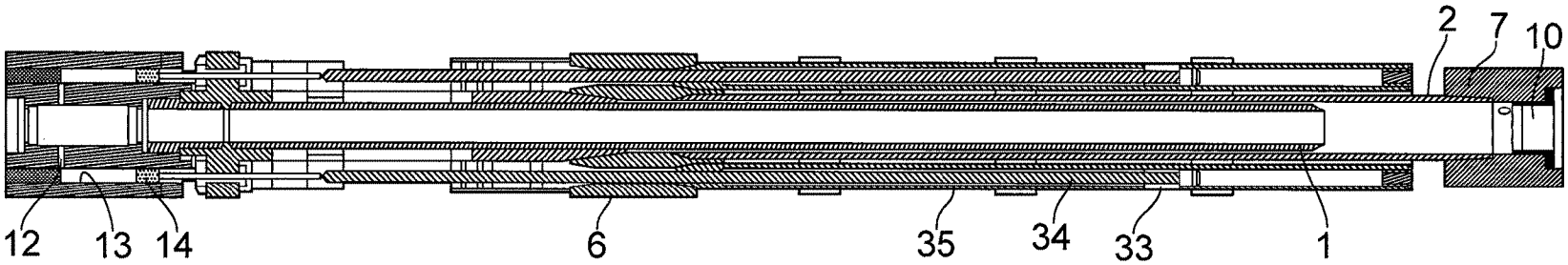
FIG. 3 is a cross section view of the safety joint of FIG. 1 shown in a partly activated mode.

FIG. 3 discloses the partly activated mode of the safety joint 4, where the tension rod(s) 20 have started to deform due to excessive tension. In the disclosed partly activated mode, the compensation of the tension rods in relation to the internal pressure in the bore 10 of the riser is transferred from the first set of cylinders 16 to the second set of cylinders 27.

The deformation of the tension rods 20 will actuate a movement of the piston rod 18, including the piston 17, of the first set of cylinders 16. When the relative movement has reached a given distance, the piston 17 is moved out of sealed abutment with a sealing surface 19 (see detailed view in FIG. 5) in a cylinder 30. One will then have a leakage across the piston 17, and this piston 17 will no longer compensate the tension rods 20 for internal pressure within the riser. This compensation is then transferred to the second set of cylinders 27. This movement also moves a thickened portion of the piston rod 18 out of locking contact with radial extending "fingers" 22 connected to the cylinder end cap/cylinder head 21. This locking contact locks the fingers 22 in contact with holding ridges 31 in the inner wall of the cylinder. When the piston 17 continues to move as the tension rods 20 are plastically deformed further, the radial extending "fingers" 22 of the cylinder end cap/cylinder head 21 interact with a release part 23 of the piston 17 and move the fingers 22 out of engagement with the complementary holding ridges 31 in the cylinder wall, thereby allowing the piston rod 18, piston 17 and cylinder head/end cap 21 of the cylinder to move upwardly in the cylinder. The piston(s) 17 of the first set of cylinders 16 are provided with the release part 23, which release part allows for flexing the fingers 22 inwardly when the piston 17 moves upwards in the cylinder. This releases the cylinders 30 in the first set of cylinders 16 into two separate parts, and no forces from the first cylinder set 16 will act on the safety joint 4. As the piston 17 moves upwardly with the piston rod 18 in the initial extension of the tension rods 20, a smaller and smaller area of the sealing surface 19 seals between the piston 17 and the cylinder 30. And, when the piston 17 has moved out of sealing engagement with the sealing surface 19, the hydraulic fluid on the upper part of the piston 17 (working on the working area 17A) will be allowed to flow around the radial outside of the piston 17 due to the increased diameter of the cylinder. Until the leakage across the piston 17, the floating piston 14 inside the axial bore 13 will move in an upward direction to the second stopping sealing surface 15B, thus providing a limit of how much fluid that can be pushed up towards the bellow 11 and thereby preventing the bellow 11 from being pushed into the internal bore 10 of the riser. Additionally, bores 19A to the surroundings are provided to allow seawater to enter and act on the lower part of the floating piston 14 when the system is in the partly activated mode. At this time the first set of cylinders 16 is no longer pressure compensating the safety joint 4 and the pressure compensation is transferred to the second set of cylinders 27, as described below.

Simultaneous with the movement of the piston rod 18 and piston 17, the inner barrel 1 will move axially upwards relative the outer barrel 2 because of the axial deformation of the tension rods 20, such that the sealing system 24 will no longer seal between the inner barrel 1 and the outer barrel 2, thus allowing the pressure in the riser to enter the volume V between the inner 1 and outer 2 barrels. The pressure/fluid will then flow through the volume V towards the manifold block 6 (detailed view in FIG. 4), through a radial bore 26 in the manifold block 6, and into one or more cylinders of the second set of cylinders 27 and act on an upper part of each piston 33 in each cylinder 35 in the second set of cylinders. Similarly to the case of the first set of cylinders 16, the upwardly working force of the riser fluids inside the bore 10, i.e. the "end cap" force, is balanced out by providing a downwardly working area that is the same or similar in size as the end cap area of the riser bore 10. The second set of cylinders 27 will also work against the separation of the first and second riser parts 8, 9 by a "vacuum effect" in each cylinder 35, i.e. by providing a vacuum or a fluid with 1 bar pressure on the lower side of each piston 33 in the cylinders 35. When the piston 33 is moved in the cylinder 35, this fluid will have a larger volume to fill, thereby creating an even lower pressure which creates a force pulling the piston 35 towards the collapsed state, i.e. the collapsed state of the cylinder 35, into the cylinder again. Additionally, the hydrostatic pressure of the seawater will act on the top area of each piston rod 34, adding an additional force in the downward direction of the system. At this point the second set of cylinders 27 will provide the pressure compensation of the safety joint 4 in relation to internal pressure within the riser.

One or more of the cylinders in the second set of cylinders 27 may be replaced by a third set of cylinders 32. This third set of cylinders 32 is not connected to the inner bore 10 of the riser but is open to the sea, resulting in the hydrostatic pressure of the seawater at the given location working on the upper side of the piston and a "vacuum effect" working on the lower side of the piston. At large water depths this third set of cylinders 32 may provide quite a substantial additional force working against separation of the first and second riser parts 8, 9 due to the large hydrostatic column of seawater.

Figure 4:
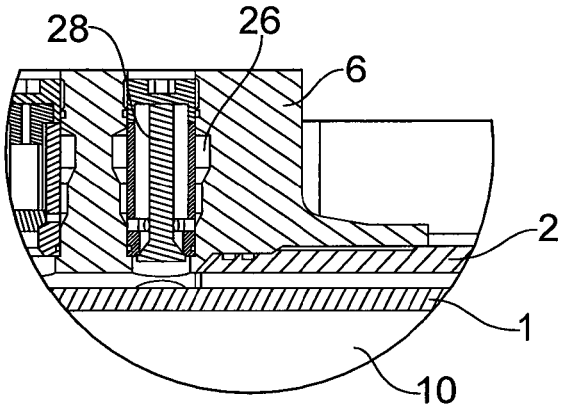
FIG. 4 is a detailed cross section view of a manifold block of the safety joint of FIG. 1.

FIG. 4 shows an embodiment of the manifold block 6 mounted to the outer barrel 2. At least one second radial bore 26 extends in the radial direction of the manifold block 6 and creates a connection between the internal fluid in the riser and the second set of cylinders 27. The second bore 26 may be fully open, or flow regulation means may be arranged in the bore 26, such as a valve, burst disc, choke valve etc. In the shown embodiment, a flow regulating means exemplified as a valve 28 is arranged in the second bore 26. The second bore 26 is connected to the volume V between the inner barrel 1 and the outer barrel 2 on one side, leading to the volume(s) of the cylinders of the second set of cylinders 27 on the other side. The safety joint 4 may be provided with access to this bore 26 from the outside of the safety joint 4, making it possible to change out any element positioned in this bore 26 without disassembling the whole safety joint 4.

Figure 6:
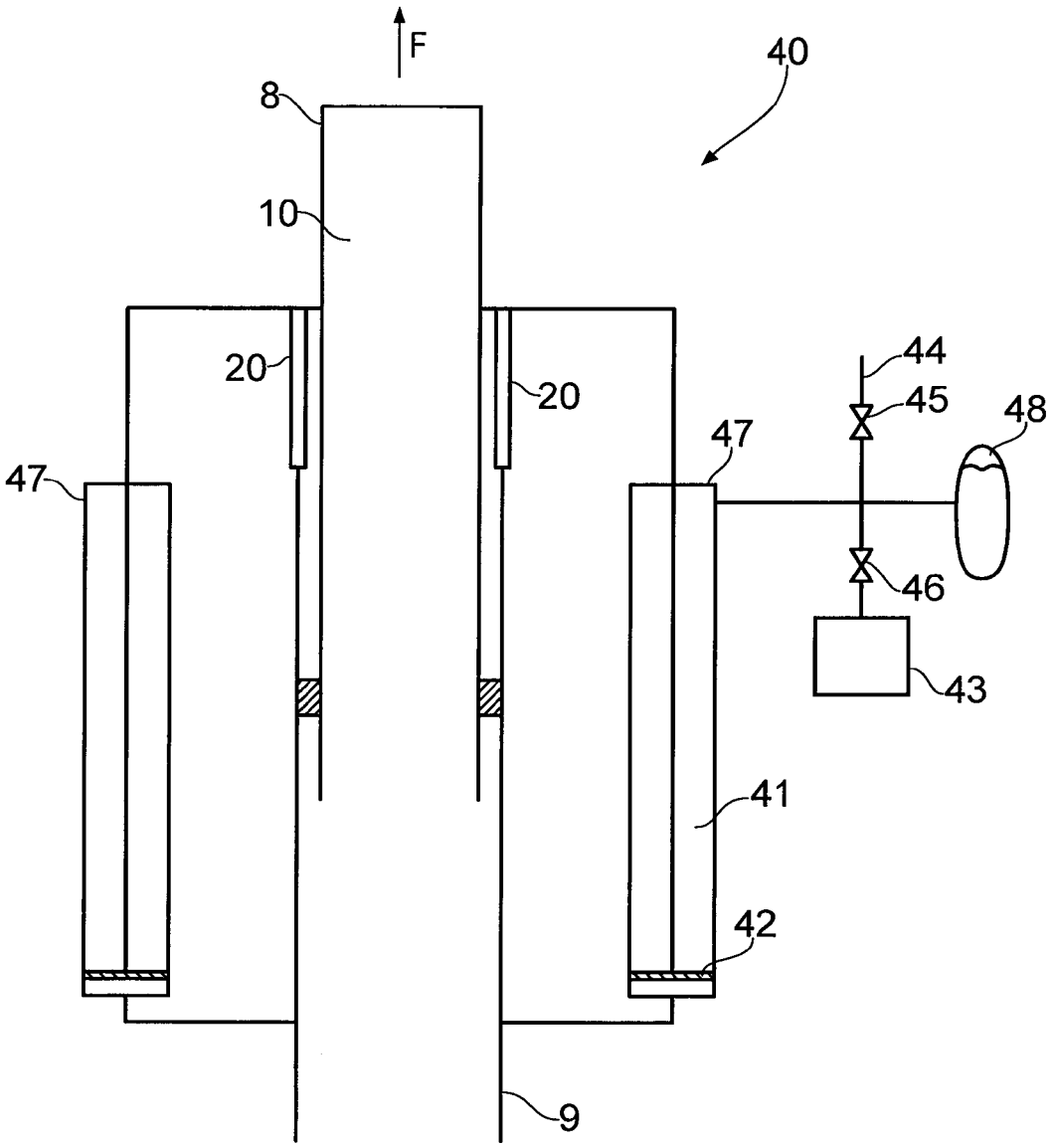
FIG. 6 is a simplified view of an override system of the present invention.

FIG. 6 shows a perspective view of an override system to be used with the safety joint or for a weak link connection between two riser parts 8, 9. The override system may be used in situations where large external forces on the system are expected, i.e. to provide a system that increases the connection force between the first and second riser parts 8, 9 and to make sure that the tension rods 20 are kept undamaged. This might be accomplished by providing a separate cylinder/piston arrangement 40 connected between the first and the second parts of the riser 8, 9, or alternatively by using the first set of cylinders 16, or a combination of the first set of cylinders 16 and the separate cylinder/piston arrangement 40 for this function. The volume 41 above the pistons 42 in the override cylinders 47 making up the separate cylinder/piston arrangement 40 is then fluid filled and locked in a set position. The fluid may be locked/trapped in the override cylinders 47 by means of a valve (not shown), which may be remotely operated. The locked/trapped fluid within the override cylinders 47 may be released to an active receiver 43 with for instance 1 bar pressure or to the sea 44. Valves 45, 46 may be provided between the sea 44 and the override cylinders 47 and between the active receiver 43 and the override cylinders 47. Alternatively, one may add an additional pressure to the fluid in the override cylinders 47 by a connection to a pressure cylinder 48 with for instance ~700 bar pressure. This override system may comprise a set of cylinders 47, including one cylinder, but preferably two or more separate cylinders so as to provide redundancy in the system.

Figure 7:
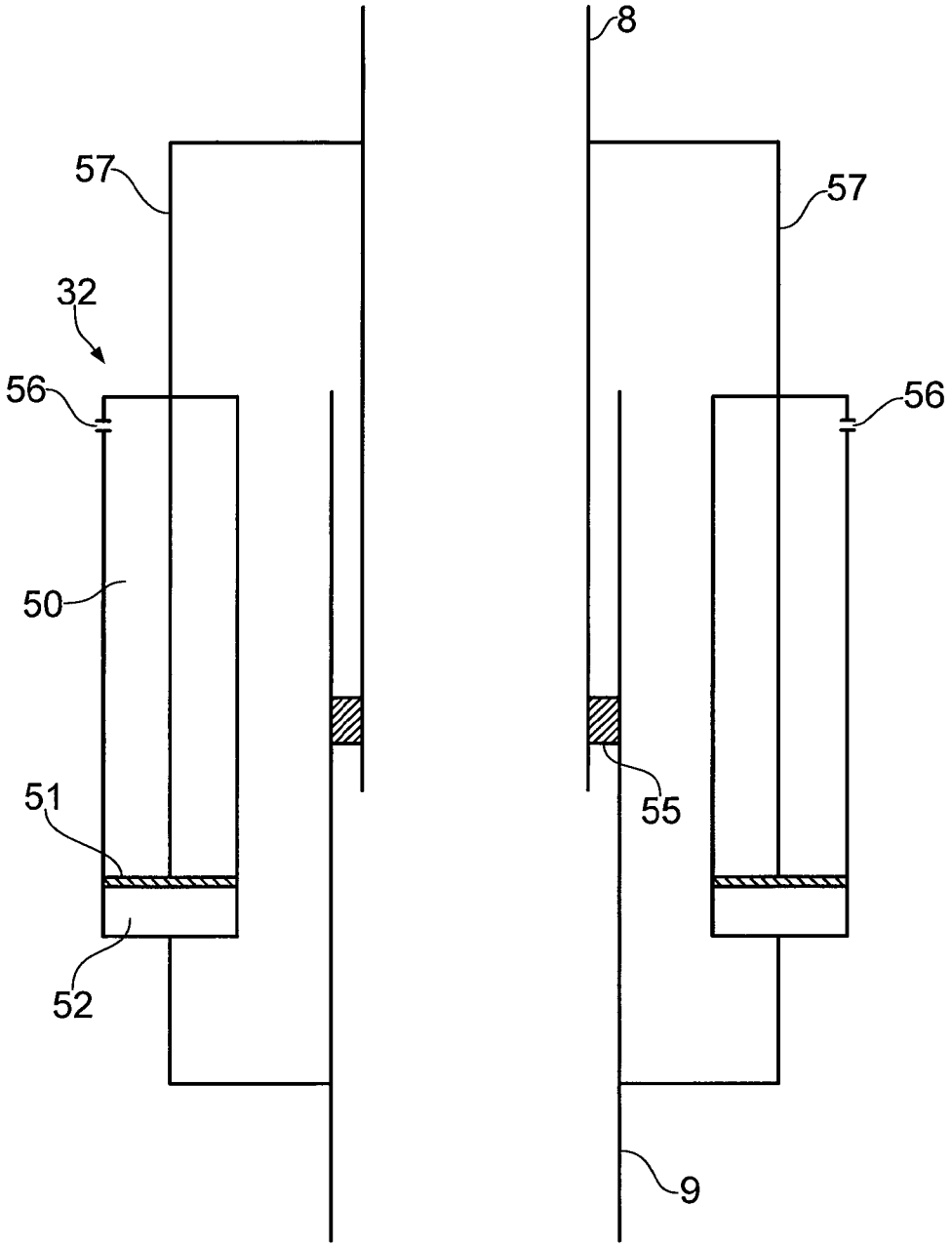
FIG. 7 is a simplified view of a third set of cylinders of the present invention.

FIG. 7 shows a simplified perspective view of a third set of cylinders. In one embodiment one may also provide the safety joint 4 with an additional third set of cylinders 32, which third set of cylinders 32 may comprise one or a plurality of cylinders and which are activated during the fully activated mode of the release unit. The cylinders of the third set of cylinders 32 are provided with at least one opening 56 to the sea in the volume 50 on the upper side of the cylinder piston 51, and have a fluid on the lower side 52 of the piston 51. The figure shows that the cylinder rod 57 is mechanically linked to the first riser part 8 and the cylinder is mechanically linked to the second riser part 9. This is the situation after the safety joint has telescoped a minor predetermined distance, whereby it should be understood that the cylinder rod 57, in appropriate ways, will be connected to the first riser part 8 after the minor telescoped distance. When the safety joint 4 is extending, the pressure from the seawater acting on the upper side of the cylinder piston 51 and the "vacuum effect" (low pressure) on the lower side of the piston 51 both assist in forcing the two riser parts 8, 9 to a collapsed state, i.e. they provide a force that acts against the separation forces in the safety joint 4.

A joint may be provided with first and second overlapping riser parts allowing telescopic movement between the two different parts, to which two parts there may be connected a cylinder arrangement comprising at least one cylinder as described in relation to the third set of cylinders above. This will give a possibility of having a heave compensating system with the seawater as the accumulator bank. In another possible configuration one may have such a joint with the addition of at least one cylinder as described in relation to the second cylinders above. One thereby obtains a pressure compensated telescopic joint with the seawater as the accumulator bank in the system.

In an alternative embodiment of the safety joint one may use another element to be plastically deformed as the safety joint is extended in the partly activated state. It is possibly to provide a sleeve in the joint and have this plastically deformed, for instance widened, to get a somewhat controlled extension of the safety joint before it reaches the fully activated state.

The invention has now been explained with reference to the accompanied drawings. A skilled person will understand that alterations and modifications to this embodiment may be made that are within the scope of the invention as defined in the attached claims.

The invention claimed is:

1. A cylinder release arrangement which comprises:

at least one cylinder, a piston positioned within the cylinder, and a cylinder head closing off one end of the cylinder to thereby form a chamber between the piston and the cylinder head;

wherein the cylinder is configured to provide a leakage of fluid from one side of the piston to the other side of the piston when the piston is located a first distance from a sealing position in which the piston is in sealing contact with a sealing surface of the cylinder; and means for controllably releasing the cylinder head from the cylinder subsequent to the leakage of fluid from one side of the piston to the other side of the piston;

wherein the means for controllably releasing the cylinder head from the cylinder comprise a release part of the piston and a number of fingers connected to the cylinder head, and wherein when the piston is moved a second distance away from the sealing position, the release part causes the fingers to move out of locking contact with the cylinder to thereby release the cylinder head from the cylinder.

2. The cylinder release arrangement in accordance with claim 1, wherein the piston is provided with a piston rod that is configured to move with the piston, and wherein the leakage of fluid from one side of the piston to the other side of the piston occurs when the piston is caused to move away from the sealing position within the cylinder.

3. The cylinder release arrangement in accordance with claim 2, wherein in the sealing position of the piston, the piston is in sealed abutment with the sealing surface in the cylinder.

4. The cylinder release arrangement in accordance with claim 2, wherein the interaction between the fingers and the release part allows for the piston, the piston rod and the cylinder head to move away from the sealing surface and release the cylinder head from the cylinder.

5. The cylinder release arrangement in accordance with claim 2, wherein when the release part is moved into interaction with the fingers, a thickened portion of the piston rod is moved out of a locking contact with the fingers.

6. The cylinder release arrangement in accordance with claim 2, wherein the fingers are configured to flex inwardly during interaction between the release part and the fingers.

7. The cylinder release arrangement in accordance with claim 5, wherein the locking contact between the thickened portion of the piston rod and the fingers locks the fingers in contact with the cylinder through engagement of the fingers with holding ridges provided on at least one of the cylinder and the fingers.

8. The cylinder release arrangement in accordance with claim 2, wherein deformation of tension rods connected between two riser parts actuates the movement of the piston rod.

9. A cylinder arrangement with a release mechanism comprising:

a cylinder;

a piston which is positioned within the cylinder and is connectable to a piston rod; and a cylinder head which closes off one end of the cylinder to thereby form a chamber between the piston and the cylinder head;

the cylinder head comprising a number of axial extending fingers which are configured to flex radial inwardly and to be locked in locking engagement to the cylinder by a thickened portion of the piston rod;

wherein the piston rod further comprises a release part which is arranged at a distance from the thickened portion and is configured to interact with the fingers such that when the piston is moved in an axial direction relative to the cylinder to a finger release position by the piston rod, the thickened portion will move out of locking interaction with the fingers and further movement of the piston rod will bring the release part into interaction with the fingers and cause the fingers to flex radially inwardly out of engagement with the cylinder to allow the cylinder head to be released from the cylinder.

10. The cylinder arrangement with a release mechanism in accordance with claim 9, wherein the piston rod comprises a first part and a separate second part on which the thickened portion and the release part of the piston rod are provided and which remains in position until the first part is connected to the second part during activation of the release mechanism.

* * * * *